United States Patent [19]

Taipale

[11] Patent Number: 4,974,642

[45] Date of Patent: Dec. 4, 1990

[54] CONNECTING THREAD ARRANGEMENT IN DUAL FABRIC PAPERMAKING FABRIC

[75] Inventor: Seppo Taipale, Siilinjärvi, Finland

[73] Assignee: Tamfelt Oy Ab, Tampere, Finland

[21] Appl. No.: 360,797

[22] Filed: Jun. 2, 1989

[30] Foreign Application Priority Data

Dec. 8, 1988 [FI] Finland ..... 885694

[51] Int. Cl.[5] ..... D03D 11/00; D03D 15/00

[52] U.S. Cl. ..... 139/383 A; 139/410

[58] Field of Search ..... 139/383 A, 425 A, 410; 162/DIG. 1, 348; 428/223, 225, 257

[56] References Cited

U.S. PATENT DOCUMENTS

| | | | |
|---|---|---|---|
| 4,554,953 | 11/1985 | Borel et al. | 139/383 A |
| 4,759,976 | 7/1988 | Dutt | 139/383 A |
| 4,815,499 | 3/1989 | Johnson | 139/383 A |
| 4,821,780 | 4/1989 | Tate | 139/383 A |

FOREIGN PATENT DOCUMENTS

| | | |
|---|---|---|
| 3705345 | 9/1988 | Fed. Rep. of Germany . |
| 3711021 | 10/1988 | Fed. Rep. of Germany . |
| 840736 | 8/1985 | Finland . |
| 854974 | 12/1985 | Finland . |
| 70947 | 7/1986 | Finland . |
| 77284 | 10/1988 | Finland . |

*Primary Examiner*—Andrew M. Falik

*Attorney, Agent, or Firm*—Lowe, Price, Leblanc, Becker & Shur

[57] ABSTRACT

A wear resistant cloth for a paper-making machine, comprises a first fabric woven from first warp and weft threads and a second fabric woven from second warp and weft threads. The weft and warp count of the first fabric is preferably twice the warp and weft count of the second fabric. The cloth further comprises connecting threads parallel with the warp threads, arranged to interconnect the fabrics so that the first fabric forms the upper surface of the cloth and the second fabric correspondingly the lower surface of the cloth. In order to improve the wear resistance of the cloth, the connecting threads are arranged to be always at the same phase as the warp thread of that one the fabrics at which the interlacing takes place. The thread count of the connecting thread is the same as the warp count of the fabric.

6 Claims, 2 Drawing Sheets

FIG. 1
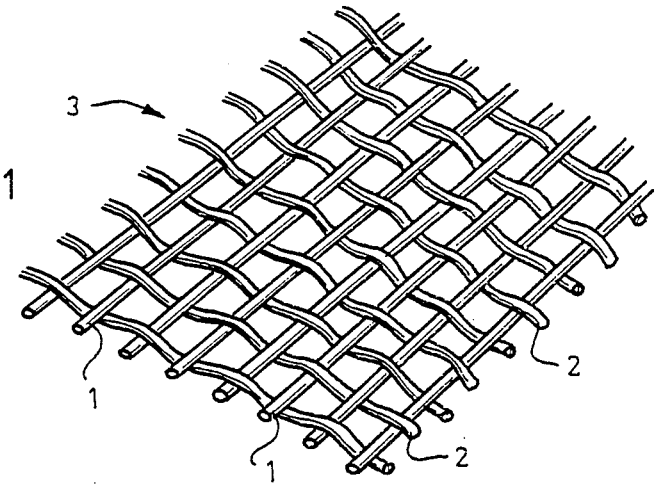
FIG. 2
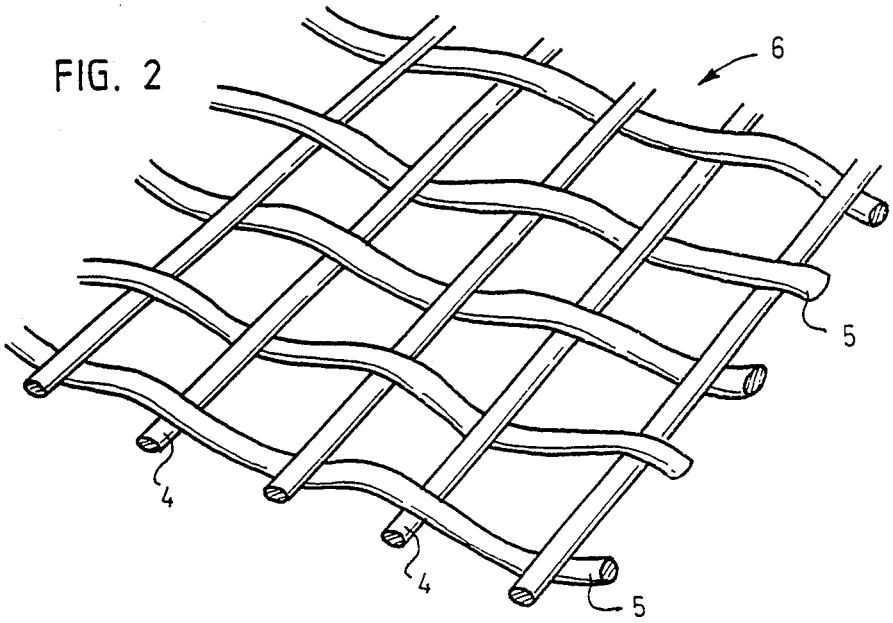
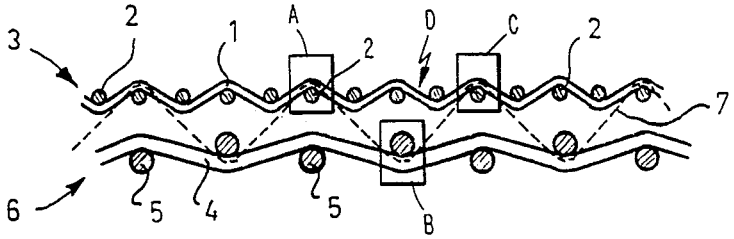
FIG. 5

CONNECTING THREAD ARRANGEMENT IN DUAL FABRIC PAPERMAKING FABRIC

This invention relates to a cloth for a paper machine, comprising a fabric woven from first warp and weft threads; a fabric woven from second warp and weft threads, the weft and warp count of the fabric woven from the first warp and weft threads being twice the warp and weft count of the fabric woven from the second warp and weft threads; and connecting threads parallel with the warp threads, the connecting threads being arranged to interconnect the fabrics so that the fabric woven from the first warp and weft threads forms the upper surface of the cloth and the fabric woven from the second warp and weft threads correspondingly lower surface of the cloth.

BACKGROUND OF THE PRIOR ART

Cloths of this type are well-known in the wood processing industry, wherein they are used, e.g., as wires in paper and cellulose machines.

Prior art solutions include the structures described in Finnish Patent Application No. 831267. A drawback of this prior art structure is that the same warp thread is used in the weave of both the upper and the lower side, whereby an optimal result cannot be obtained.

Another prior art structure is disclosed in Finnish Patent Application No. 840736. This structure is formed by interconnecting the layers of the cloth either by means of the warp threads of the lower layer or by means of the warp threads of the upper layer. A drawback is that long thread floats occur on the paper side of the wire because, as viewed in the warp direction, there are several weft threads before the warp thread is again at the stage where the observation was initiated.

Finnish Published Specification No. 70947, too, teaches the interconnection of two fabrics by means of warp-direction threads. The end result obtained by this prior art solution, however, is not sufficiently good, because serious irregularities occur on the paper side of the wire.

SUMMARY OF THE DISCLOSURE

The principal object of the invention is to provide a cloth for a paper machine, by means of which the drawbacks of the prior art can be eliminated. This is achieved by forming a paper machine cloth according the invention, which is characterized in that the connecting threads are arranged to be always at the same phase as the warp thread of the fabric at which the interlacing takes place and that the thread count of the connecting threads is the same as the warp count of the fabric woven from the second warp and weft threads.

An advantage of the paper machine cloth according to the invention is that the wire does not have any marking effect and is wear resistant. No binding weft threads are needed, so the problems caused by their use are fully eliminated. The lower side of the wire, that is, the wear side, can be formed so that its wear resistance is the best possible. Advantageous height differences are provided between the warp threads and the weft threads on the lower side. This is due to the fact that the threads interconnecting the fabrics have a binding effect on the threads.

BRIEF DESCRIPTION OF THE DRAWING

In the following, the invention will be described by means of a preferred embodiment shown in the attached drawing, wherein:

FIG. 1 is a general perspective view of a woven fabric forming the upper surface of a paper machine cloth;

FIG. 2 is a general perspective view of a woven fabric forming the lower surface of the paper machine cloth;

FIG. 5 shows the paper machine cloth of FIGS. 3 and 4 seen in the direction of the weft threads.

DESCRIPTION OF THE EMBODIMENT

Figure 3:
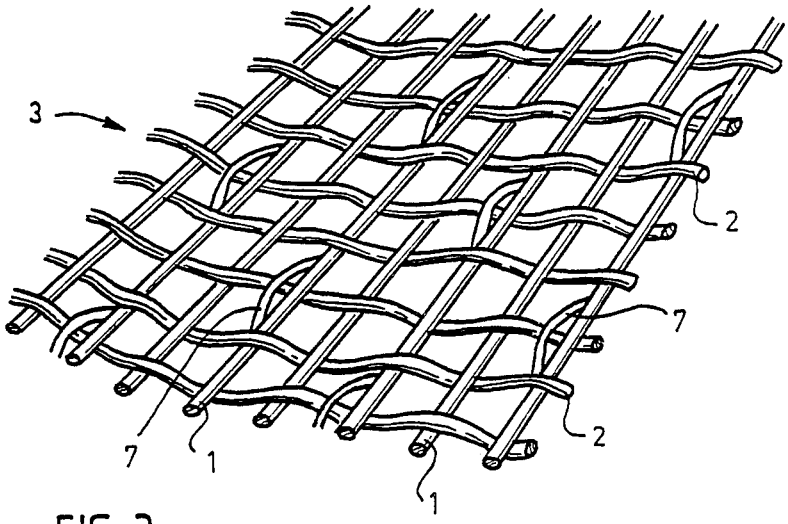
FIG. 3 is a perspective top view of the paper machine cloth according to the invention.

FIG. 1 shows a fabric 3 woven from first warp and weft threads 1, 2. This fabric forms the upper surface of the paper machine cloth according to the invention.

FIG. 2 shows a fabric 6 woven from second warp and weft threads 4, 5. This fabric forms the lower surface of the paper machine cloth according to the invention, that is, the wear surface.

Both of these fabrics are finished woven fabrics. FIGS. 1 and 2 illustrate generally the fabrics 3 and 6, so it is to be understood that the fabrics need not be exactly similar to those shown in the figures but other solutions are possible as well.

Figure 4:
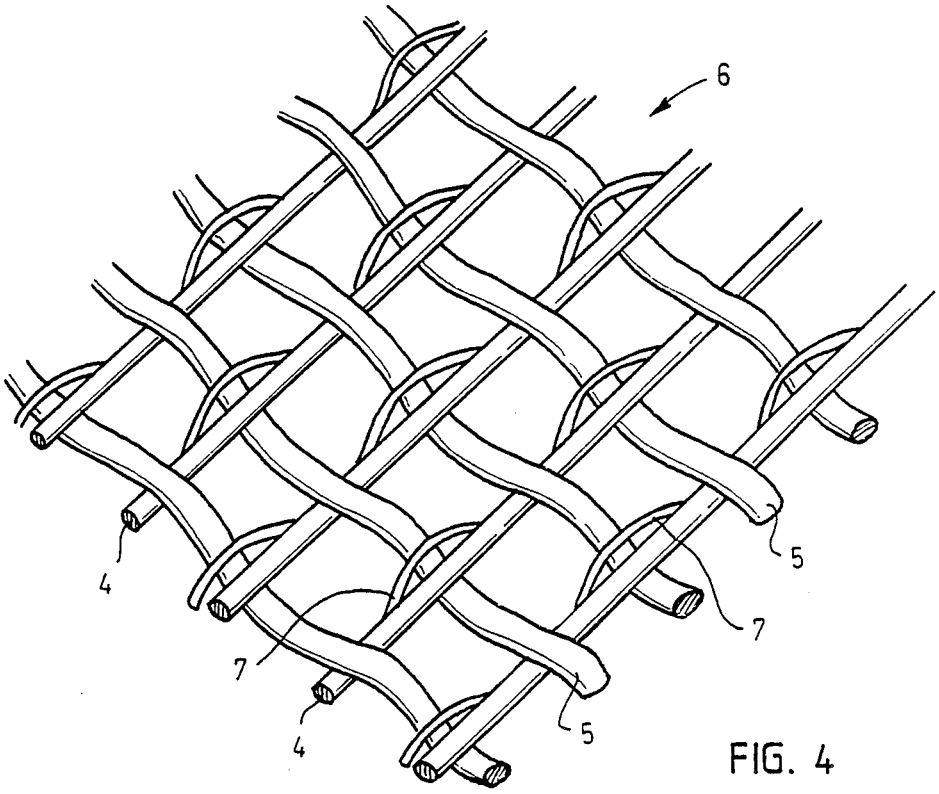
FIG. 4 is a perspective bottom view of the paper machine cloth of FIG. 3.

In the invention, the fabrics 3 and 6 are interconnected by means of connecting threads 7 parallel to the warp threads 1, 4 so that the connecting threads 7 are always at the same phase as the warp thread 1, 4 of the fabric 3 or 6 beside which the interlacing takes place. This appears clearly from FIGS. 3 to 5. As to FIGS. 3 and 4, it should be noted that the figures show only details in the upper surface of the cloth (FIG. 3) and in the lower surface of the cloth (FIG. 4). The thread floats of the connecting thread, for instance, are shown at the interlacing points only, while the whole fabric structure is shown in FIG. 5.

As appears from he figures, the thread count (i.e. the number of threads per unit of measurement).

The phrase "same phase" means that the connecting thread 7 runs at the same slope or direction as the warp threads 1 or 4 at the points where the connecting thread 7 interlaces with the weft threads 2 and 5. For example, the connecting thread 7 has an increasing slope and warp thread 1 has an increasing slope at interface points A and C as shown in FIG. 5, i.e., they have the same phase. Similarly, the connecting thread 7 has a decreasing slope and the warp thread 5 has a decreasing slope at interface point B and therefore also have the same phase. The connecting thread 7 and the warp thread 1 would not have the same phase if the connecting thread 7 wrapped around the weft thread 2 at point D.

As appears from the figures, the thread count (i.e. the number of threads per unit of measurement). of the connecting threads 7 is the same as that of the warp threads 4 of the fabric 6. Furthermore, it has been found that it is advantageous to arrange the connecting threads 7 in such a manner that they go from one fabric to the other as often as possible. Also, the connecting threads 7 are preferably thinner than the other warp threads 1, 4.

In the example of the figures, the fabric 3 is formed by a plain weave. The connecting thread 7 interconnecting the fabrics 3 and 6 also forms a plain weave if the structure is seen with respect to the fabric 6. The fabric 6 also forms a plain weave. However, it should be noted that weaves of some other type can be used as well, provided that the thread count of the connecting thread 7 interconnecting the fabrics is the same as the warp count of the fabric 6 forming the lower surface.

As appears from the figures, the structure is such that when the connecting thread 7 comes to the upper surface of the fabric 3, the warp thread 1 of the fabric 3 positioned beside the connecting thread 7 is at the same phase as the connecting thread. The same is repeated on the wear side of the wire, as is to be seen from FIG. 4. The connecting thread interconnecting the fabrics 3, 6 is thus always at the same phase as the warp thread of the fabric at which the interlacing takes place in each specific case. Such a weave structure, which could be called a balanced weave structure in which the count of the thread interconnecting the fabrics is the same as the thread count of the outer fabric, does not cause so called diagonal marking in the wire and the interlacing points do not form hollows, because the connecting thread 7 woven in the structure is sufficiently loose. When weaving the structure according to the invention, the connecting thread 7 going from one fabric to the other is at least 14% looser than the warp thread 1 of the fabric 3, and at least 9% looser than the warp thread 4 of the fabric 6. Furthermore, it is advantageous that the connecting thread 7 connecting the fabrics on the wear surface is always covered, i.e., protected by an adjacent thicker warp thread 4, so that the connecting thread does not become subject to wear until at the stage when the wire anyway has to be removed from the paper machine.

Possible thread thicknesses include the following values:

| | | |
|---|---|---|
| Fabric 3: | warp thread 1 | diameter 0.17 mm |
| | weft thread 2 | diameter 0.17 mm |
| Fabric 6: | warp thread 4 | diameter 0.25 mm |
| | weft thread 5 | diameter 0.25 mm |
| | Connecting thread 7 | diameter 0.13 mm. |

The embodiment described above is by no means intended to restrict the invention, but the invention can be modified within the scope of the claims completely freely. Accordingly, it is obvious that the fabrics need not be exactly similar to those shown in the figures, but other solutions are possible as well. The thickness of the threads used in the invention is not restricted. The thread thicknesses may thus vary according to the requirements in each particular case.

I claim:

1. A cloth for a paper machine, comprising:

a first fabric woven from first warp and weft threads;

a second fabric woven from second warp and weft threads, the weft and warp count of the first fabric being twice the warp and weft count of the second fabric; and connecting threads parallel with the warp threads, the connecting threads being arranged to interconnect the first and second fabrics so that the first fabric forms the upper surface of the cloth and the second fabric forms the lower surface of the cloth, wherein the connecting threads are arranged to always be at the same phase as the warp threads of the first and second fabrics at least at some of the points where interlacing between the warp and weft thread of said first and second fabrics takes place and the thread count of the connecting threads ar the same as the warp count of the second fabric.

2. A cloth according to claim 1, wherein: the connecting threads are arranged to go form one fabric to the other at each point where the phase of the connecting threads are the same as the phase of the warp threads of the first and second fabrics.

3. A cloth according to claim 2, wherein:

said first warp and weft threads are each 0.17 mm. in diameter;

said second warp and weft threads are each 0.25 mm. in diameter; and said connecting threads are each 0.13 mm. in diameter.

4. A cloth according to claim, wherein:

the connecting threads are of smaller diameter than the warp threads of either of the first and second fabrics.

5. A cloth according to claim 3, wherein:

said first warp and weft threads are each 0.17 mm. in diameter;

said second warp and weft threads are each 0.25 mm. in diameter; and said connecting threads are each 0.13 mm. in diameter.

6. A cloth according to claim 1, wherein:

said first warp and weft threads are each 0.17 mm. in diameter:

said second warp and weft threads are each 0.25 mm. in diameter; and said connecting threads are each 0.13 mm. in diameter.

* * * * *

UNITED STATES PATENT AND TRADEMARK OFFICE

CERTIFICATE OF CORRECTION

PATENT NO. : 4,974,642

DATED : December 4, 1990

INVENTOR(S) : Seppo Taipale

It is certified that error appears in the above-identified patent and that said Letters Patent is hereby corrected as shown below:

On the title page item [54] and column 1, lines 1 and 2, the Title should read as follows:

--CLOTH FOR A PAPER MACHINE WITHIMPROVED WEAR RESISTANCE--.

Signed and Sealed this

Seventh Day of April, 1992

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,974,642

DATED : December 4, 1990

INVENTOR(S) : Seppo Taipale

It is certified that error appears in the above-identified patent and that said Letters Patent is hereby corrected as shown below:

On the title page item [54] and column 1, lines 1 and 2, the Title should read as follows:

--CLOTH FOR A PAPER MACHINE WITH IMPROVED WEAR RESISTANCE--.

This certificate supersedes Certificate of Correction issued April 7, 1992.

Signed and Sealed this

Twenty-sixth Day of May, 1992

*Attest:*

DOUGLAS B. COMER

*Attesting Officer*

*Acting Commissioner of Patents and Trademarks*